US007837303B2

(12) United States Patent
Bengali

(10) Patent No.: US 7,837,303 B2
(45) Date of Patent: Nov. 23, 2010

(54) INKJET PRINTHEAD

(75) Inventor: Sadiq Bengali, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 353 days.

(21) Appl. No.: 12/191,076

(22) Filed: Aug. 13, 2008

(65) Prior Publication Data

US 2009/0096840 A1 Apr. 16, 2009

Related U.S. Application Data

(62) Division of application No. 11/106,957, filed on Apr. 15, 2005, now Pat. No. 7,427,125.

(51) Int. Cl.
*B41J 2/05* (2006.01)

(52) U.S. Cl. ..... 347/62; 347/65

(58) Field of Classification Search ..... 347/65
See application file for complete search history.

(56) References Cited

U.S. PATENT DOCUMENTS 5,387,314 A 2/1995 Baughman et al.
5,441,593 A 8/1995 Baughman et al.
5,519,423 A 5/1996 Moritz, III et al.
5,608,436 A 3/1997 Baughman et al.
5,635,968 A 6/1997 Bhaskar et al.
5,946,012 A 8/1999 Courian et al.
6,238,269 B1 5/2001 Pollard et al.
6,283,584 B1 * 9/2001 Powers et al. ..... 347/65
6,475,402 B2 11/2002 Nordstrom et al.
6,502,915 B1 1/2003 Feinn et al.
6,739,519 B2 5/2004 Stout et al.
6,764,605 B2 7/2004 Donaldson et al.
2003/0038864 A1 * 2/2003 Mou et al. ..... 347/63

* cited by examiner

*Primary Examiner*—Matthew Luu
*Assistant Examiner*—Lisa M Solomon

(57) ABSTRACT

An inkjet printhead includes a substrate having an ink feed hole formed therethrough and a plurality of ink drop generators formed on the substrate. The drop generators define a stagger pattern, and the ink feed hole defines a sidewall that is shaped so as to match the stagger pattern. In one embodiment, a support membrane is embedded in the substrate along an edge of the ink feed hole.

3 Claims, 5 Drawing Sheets

INKJET PRINTHEAD

This application is a divisional of 11/106,957, filed Apr. 15, 2005 now U.S. Pat. No. 7,427,125 which is hereby incorporated by reference.

BACKGROUND OF THE INVENTION

This invention relates generally to inkjet printing and more particularly to inkjet printheads.

Inkjet printing technology is used in many commercial products such as computer printers, graphics plotters, copiers, and facsimile machines. Generally, inkjet printing employs a printhead that ejects drops of ink through a plurality of nozzles or orifices onto a print medium such as a sheet of paper. One common printhead architecture used for thermal inkjet printing comprises a substrate having at least one ink feed hole and a plurality of ink drop generators arranged around the ink feed hole. Each ink drop generator includes a firing chamber in fluid communication with the ink feed hole. A heating element such as a resistor is located in each firing chamber. Ink is caused to be ejected through a selected nozzle by passing current through the associated resistor, which heats the ink in the firing chamber to a cavitation point. The resistors are typically formed as part of one or more thin film stacks disposed on top of the substrate. It is common to stagger the resistors relative to one another (a feature known as "resister stagger") to improve performance of the printhead.

Printheads are commonly fabricated on a silicon wafer substrate using photolithography techniques. With this approach, it is possible for the thin film stacks to become undercut during etching of the ink feed hole. Thin film undercut generally varies between 8-10 microns, with occasional excursions up to 12-14 microns. This undercut presents a relatively fragile area that can fracture under stress experienced during operation.

Another issue with the above-described printhead architecture pertains to shelf length. As used herein, the term "shelf length" refers to the distance, for a given ink drop generator, from the center of the resistor to the edge of the ink feed hole adjacent to the ink drop generator. Here, the shelf lengths are relatively long (30-45 microns) and unequal because of resistor stagger. This results in increased nozzle-to-nozzle drop weight variability and reduced refill rates, which leads to less uniform printing and lower frequency operation.

SUMMARY OF THE INVENTION

In one embodiment, the present invention provides an inkjet printhead that includes a substrate having an ink feed hole formed therethrough and a plurality of ink drop generators formed on the substrate. The drop generators define a stagger pattern, and the ink feed hole defines a sidewall that is shaped so as to match the stagger pattern.

In another embodiment, the present invention provides a thermal inkjet printhead that includes a substrate having an ink feed hole formed therethrough and a thin film stack disposed on the substrate. The thin film stack has a plurality of staggered resistors, and the ink feed hole has sidewalls that are zigzagged so as to match the stagger of the resistors. The thin film stack is undercut by the ink feed hole; and the printhead includes means for supporting the thin film stack undercut.

In a further embodiment, the present invention provides a thermal inkjet printhead that includes a substrate having an ink feed hole formed therethrough, the ink feed hole being defined by at least one edge. A support membrane embedded in the substrate along the ink feed hole edge, and a plurality of ink drop generators is formed on the substrate and arranged around the ink feed hole. Each ink drop generator includes a heater element, and each heating element is staggered with respect to at least one other heating element. The ink feed hole edge is zigzagged so that the distance from the center of the heating element to the ink feed hole edge is equal for each ink drop generator.

In still another embodiment, the present invention provides an inkjet pen that includes a body and an ink source within the body. The inkjet pen further includes a printhead having at least one ink feed hole in fluid communication with the ink source and a plurality of ink drop generators arranged around the ink feed hole, wherein the ink drop generators define a stagger pattern and the ink feed hole has a sidewall that is shaped so as to match the stagger pattern.

In yet another embodiment, the present invention provides a method of fabricating an inkjet printhead. The method includes providing a substrate having first and second opposing surfaces and embedding a support membrane in the first surface. A plurality of ink drop generators is formed on the first surface, the ink drop generators defining a stagger pattern. An ink feed hole is formed in the substrate by etching the second surface, wherein the ink feed hole has sidewalls that are zigzagged so as to match the stagger pattern.

In still another embodiment, the present invention provides a method of printing using a pen having an ink source. The method includes providing a printhead having a substrate and a plurality of ink drop generators formed on the substrate, the ink drop generators defining a stagger pattern. Ink is delivered from the ink source to the ink drop generators via an ink feed hole formed in the substrate, wherein the ink feed hole defines sidewalls that are zigzagged so as to match the stagger pattern. The method also includes selectively heating ink in the ink drop generators to eject drops of ink.

The present invention and its advantages over the prior art will be more readily understood upon reading the following detailed description and the appended claims with reference to the accompanying drawings.

DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
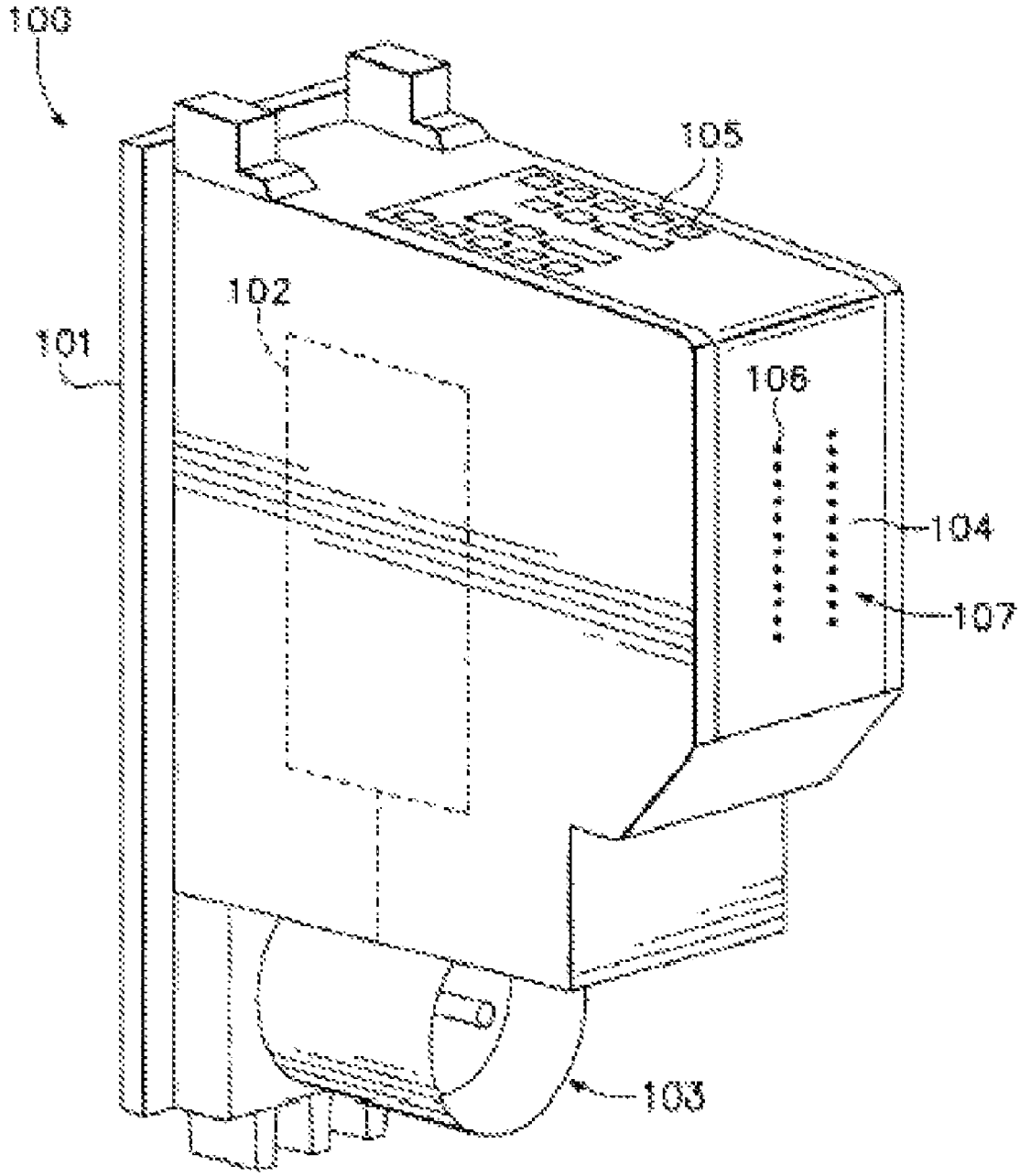
FIG. 1 is a perspective view of an inkjet pen.

Referring to the drawings wherein identical reference numerals denote the same elements throughout the various views, FIG. 1 shows a simplistic schematic of a swath-scanning thermal inkjet pen 100. The pen 100 includes a body 101 that generally contains an ink source and regulator mechanism 102. The ink source 102 can comprise an internal ink accumulation chamber that is fluidly coupled to an off-axis ink reservoir (not shown) via a coupling 103. Alternatively, the ink source 102 can comprise an ink reservoir wholly contained within the pen body 101. A printhead 104 is mounted on an outer surface of the pen body 101. Appropriate electrical connectors 105 (such as a tape automated bonding, "flex tape") are provided for transmitting signals to and from the printhead 104. The printhead 104 has columns of individual nozzles 106 forming an addressable firing array 107. Although only a relatively small number of nozzles 106 is shown in FIG. 1, the printhead 104 may have two or more columns with more than one hundred nozzles 106 per column, as is common in the printhead art. The nozzle array 107 is usually subdivided into discrete subsets, known as "primitives," which are dedicated to firing droplets of specific colorants on demand. The printhead 104 includes an ink drop generator (not shown in FIG. 1) subjacent each nozzle 106.

Figure 2:
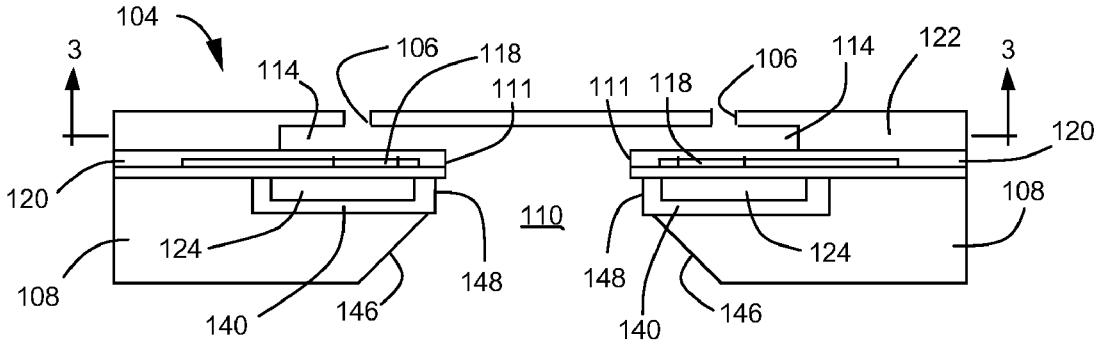
FIG. 2 is cross-sectional side view of a thermal inkjet printhead.
Figure 3:
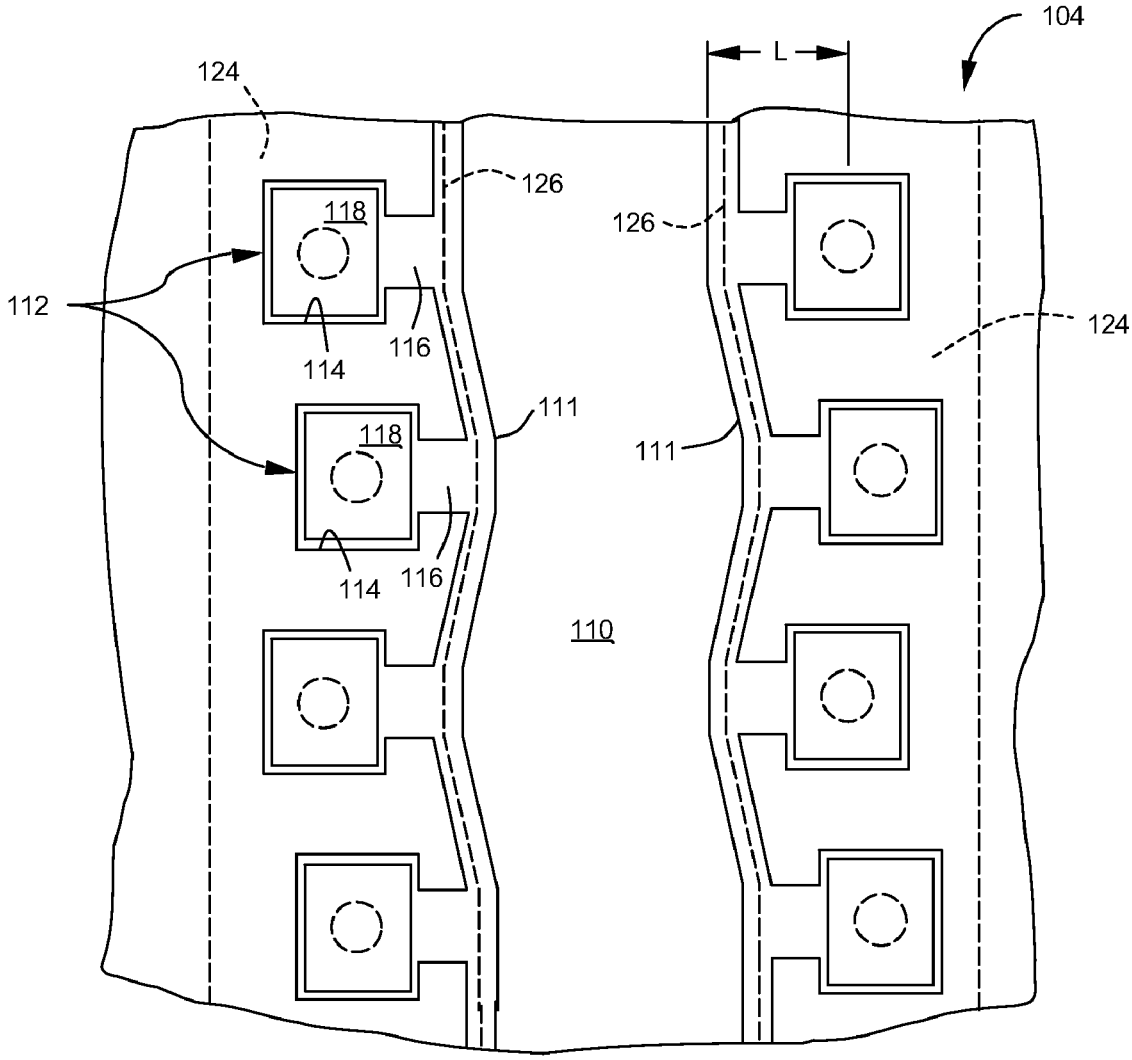
FIG. 3 is a top plan view of a portion of the printhead taken along line 3-3 of FIG. 2.

Referring to FIGS. 2 and 3, the printhead 104 includes a substrate 108 having at least one ink feed hole 110 formed therein with a plurality of ink drop generators 112 arranged around the ink feed hole 110. Each ink drop generator 112 includes a firing chamber 114, an ink feed channel 116 establishing fluid communication between the ink feed hole 110 and the firing chamber 114, and a resistor or similar heating element 118 disposed in the firing chamber 114. The resistors 118 are contained within thin film stacks 120 that are disposed on top of the substrate 108. As is known in the art, the thin film stacks 120 generally contain an oxide layer, a metal layer that defines the resistors 118 and conductive traces, and a passivation layer. An orifice layer 122 formed on top of the thin film stacks 120 and the substrate 108 defines the firing chambers 114 and the nozzles 106. Although FIGS. 2 and 3 depict one common printhead configuration, namely, two rows of ink drop generators about a common ink feed hole, other configurations useful in thermal inkjet printing may also be formed in the practice of the present invention.

In operation, ink is introduced into the firing chamber 114 from the ink feed hole 110 (which is in fluid communication with the ink source 102 (FIG. 1)) via the ink feed channel 116. Selectively passing current through the resistor 118 superheats the ink in the associated firing chamber 114 to a cavitation point such that an ink bubble's expansion and collapse ejects a droplet through the associated nozzle 106. The firing chamber 114 is then refilled with ink from the ink feed hole 110 via the ink feed channel 116 for the next operation.

Figure 4:
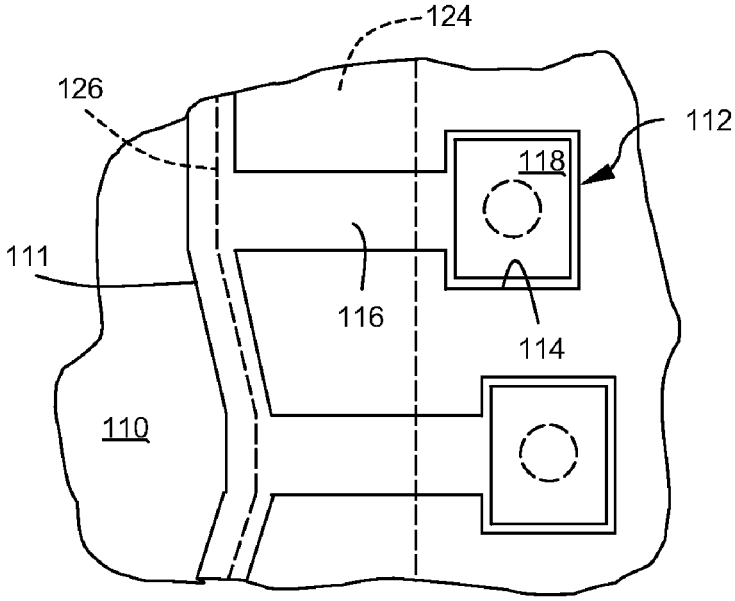
FIG. 4 is a top plan view of a portion of alternative embodiment of a thermal inkjet printhead.

In accordance with one embodiment of the present invention, the printhead 104 includes support membranes 124 embedded into a surface of the substrate 108, adjacent to the ink feed hole 110 and underneath the thin film stacks 120. The support membranes 124 preferably comprise a material having a substantially equal or greater load bearing characteristic than silicon. One such suitable material is polysilicon. The support membranes 124 are located in the region where the fragile thin film undercut occurs so as to provide mechanical rigidity and structural support. Preliminary mechanical modeling results indicate that the support membranes 124 increase the mechanical strength of the fragile edges 111 defining the ink feed hole 110 by several orders of magnitude. The support membranes 124 can also increase structural support for the resistors 118. That is, the resistors 118 are positioned over the support membranes 124 as shown in FIG. 3. Alternatively, the resistors 118 need not be located over the support membranes 124, as shown in FIG. 4, where additional structural support for the resistors 118 is not needed. In this case, the support membranes 124 primarily function to support the thin film undercut.

As best seen in FIG. 3, the positions of the ink drop generators 112, and thus the resistors 118, are staggered so as to define a stagger pattern. This feature, which is known as "resister stagger" is common in the printhead art. In the illustrated embodiment, the ink feed hole edges 111 are zigzagged to match the stagger pattern of the ink drop generators 112 and the resistors 118. In other words, the edges 111 are shaped to follow the contour defined by the staggered resistors. The inner edges 126 (i.e., the edges adjacent the ink feed hole 110) of the support membranes 124 are similarly zigzagged, as is shown in phantom lines in FIG. 3. The shaped ink feed hole edges 111 allow the printhead 104 to have equal shelf lengths, L, for all of the ink drop generators 112. (As mentioned above, the term "shelf length" for a given ink drop generator refers to the distance from the ink feed hole edge adjacent to the ink drop generator to the center of the corresponding resistor.) By providing equal shelf lengths for all of the ink drop generators 112, drop weight variability between nozzles 106 is significantly reduced in the printhead 104. Furthermore, the mechanical robustness provided by the support membranes 124 allows the equal shelf lengths to be significantly shorter (e.g., a 40-50% reduction) than typical shelf lengths found in conventional printheads. In one embodiment, shelf lengths will be in the range of about 10-20 microns. This allows for higher refill rates (i.e., higher frequency operation) and potentially permits use of higher viscosity inks.

Figure 5:
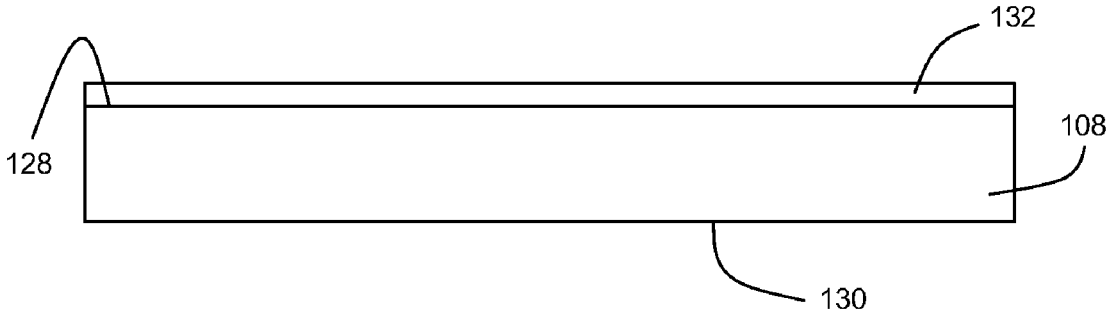
FIGS. 5-14 are cross-sectional side views illustrating the fabrication of a thermal inkjet printhead.

Referring now to FIGS. 5-13, a process for fabricating an inkjet printhead 104 is described. It should be noted that these illustrations are schematics for a very small region of a silicon wafer that may be many orders of magnitude greater in dimension to the shown die region. The process starts with a substrate 108, which is typically a silicon wafer. The substrate 108 has a first planar surface 128 and a second planar surface 130, opposite the first surface. The first surface 128 is also referred to herein as the frontside surface, which is the side that will have ink drop generators 112 formed thereon. The second surface 130 is also referred to herein as the backside surface, which is the side that will face the ink source 102 of the pen 100. An oxide layer 132, which can be, for example, a thermal oxide layer, is grown or deposited on the frontside surface 128, as shown in FIG. 5. The oxide layer 132 protects the substrate 108 during a subsequent trench etching operation described below. The thickness of the oxide layer 132 will be dependent upon the implementation of the subsequent trench etching operation. In general, the thickness will be in the range of about 1000-3000 angstroms.

Figure 6:
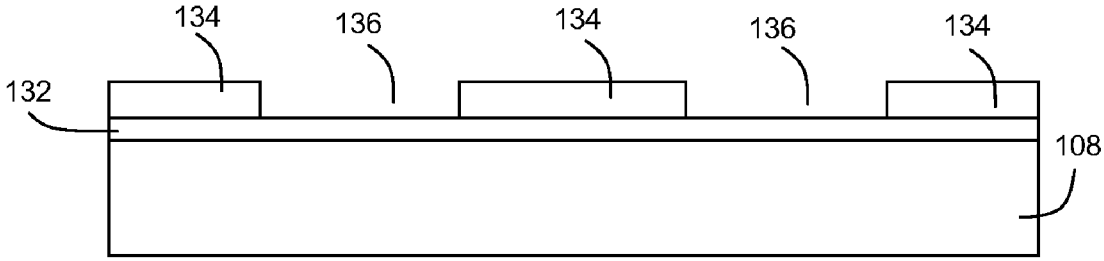

Referring to FIG. 6, a layer of photoresist 134 is formed superjacent the oxide layer 132 in any suitable manner. Photolithography processes are used to selectively remove regions of the photoresist 134, thereby forming a mask having a pattern associated with forming trenches or depressions in which the above-mentioned support membranes 124 will be formed. In other words, the portions of the photoresist 134 are removed to define a photoresist mask that delineates regions 136 where the support membranes 124 are to be formed. These regions 136 are formed with zigzagged edges so that the inner edges 126 of the support membranes 124 will be zigzagged to match the stagger pattern of the printhead 104.

Figure 7:
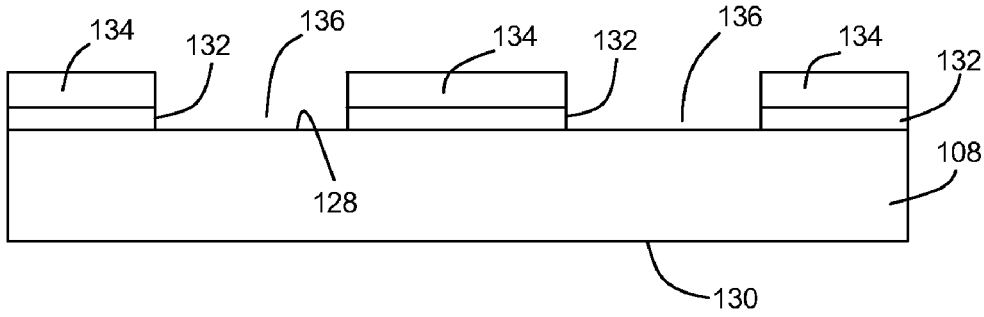
Figure 8:
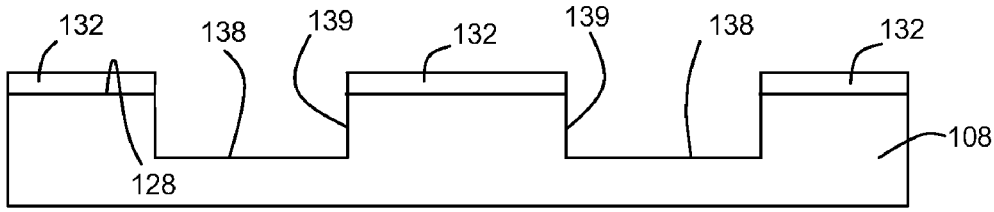

The oxide layer 132 is then etched using the photoresist mask, as shown in FIG. 7, via a suitable etching process such as a dry etch. This exposes the regions 136 on the frontside surface 128 of the substrate 108. Referring to FIG. 8, the photoresist 134 is then stripped using any suitable technique. After the oxide layer 132 is patterned to expose the substrate 108 in the desired regions 136, an etching process removes silicon from the substrate 108 to form trenches or depressions 138 on the substrate frontside surface 128. The etched trenches 138 will generally have a depth from the frontside surface 128 in the range of approximately 1-20 microns, and preferably about 10-15 microns. The inner edges 139 of the trenches 138 will be zigzagged per the zigzagged shape of the photoresist mask.

In one embodiment, the frontside trench etching operation is a dry etch process. Dry etching, which generally provides better dimensional control, allows patterning directly on the substrate frontside surface 128 without first growing an oxide layer—the photoresist mask 134 is formed directly on the frontside surface 128. In other words, the oxide layer 132 can be omitted if dry etching is used in the trench etching operation. However, the oxide layer 132 may still be beneficial as an additional mask to control the etching rate and depth, particularly for deeper trench depths. It may also be desirable to use an oxide layer as part of the mask if silicon contamination problems are a concern. Determining whether to use an oxide layer in a given etching operation and calculating the specific thickness of the oxide layer 132 and the photoresist layer 134 are within the capabilities of those skilled in the art. A variety of dry etch techniques, such as fluorine- or chlorine-based dry etch processes, can be employed.

Figure 9:
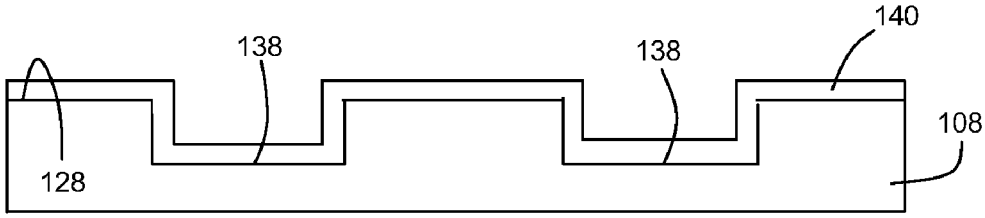

Referring to FIG. 9, the remaining oxide layer 132 is stripped via any suitable process, such as a buffered oxide etch or any other etch process now known or later developed, and a trench oxide layer 140 is grown over the frontside surface 128 of the substrate 108. The trench oxide layer 140 can be, for example, a thermal oxide layer. Note that alternative materials, such as a silicon-based dielectric material, may be used instead of a thermal oxide. The trench oxide layer 140 is deposited over the entire frontside surface 128 and follows the trenches 138 formed by the previous etching process. In one embodiment, the trench oxide layer 140 has a thickness of approximately 500-6,000 angstroms.

Figure 10:
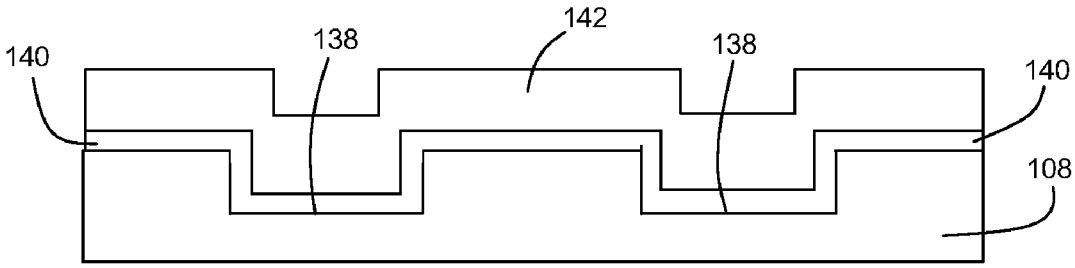

Next, as shown in FIG. 10, a support membrane layer 142 is deposited on top of the trench oxide layer 140 using any known or later developed deposition technique. Preferably, the support membrane layer 142 comprises at least one material having a substantially equal or greater load bearing characteristic than silicon. As mentioned previously, polysilicon is one particularly suitable material. For example, the support membrane layer 142 could be a polysilicon layer deposited with a batch epitaxial reactor. The support membrane layer 142 should be thick enough to fill the trenches 138; in one possible implementation, the support membrane layer 142 should have a thickness in the range of approximately 2.5-10 microns above the frontside surface 128.

Figure 11:
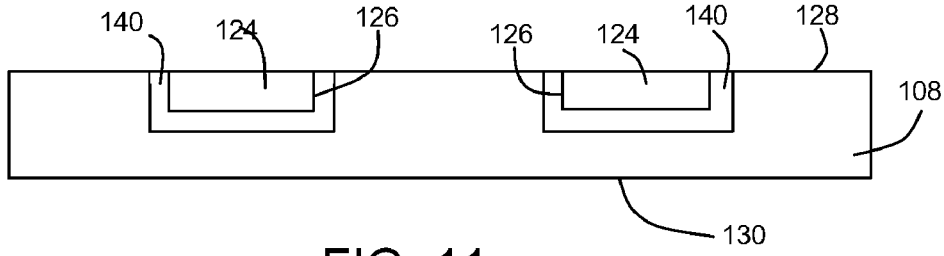

The support membrane layer 142 and the trench oxide layer 140 are then processed, such as through a polishing operation, to bring the layer materials (e.g., polysilicon and oxide) flush with the frontside surface 128 of the substrate 108, as shown in FIG. 11. The polished surface provides a flat base for receiving subsequent components. The polishing process can be, for example, a chemical mechanical polishing (CMP) process. In one embodiment, the CMP process has a high selectivity to oxide to prevent over-polishing by slowing the polish rate of the trench oxide layer 140 relative to the support membrane layer 142. The support membrane layer material remaining in the trenches 138 form the support membranes 124, which typically will be approximately 10-12 microns thick. Because the trenches 138 are formed with zigzagged inner edges 139, the inner edges 126 of the support membranes 124 are also zigzagged to match the stagger pattern.

After polishing, thin film stacks 120 are applied on the frontside surface 128, covering the exposed surfaces of the support membranes 124. In one embodiment, the film stacks 120 include, for example, an oxide layer, such as a field oxide (FOX) or tetraethylorthosilicate (TEOS) oxide, grown as a bottom layer directly onto the substrate 108, a conductive metal layer, forming conductive traces and the resistors 118, a passivation layer, and a DSO layer. The passivation layers are generally formed, for example, of tantalum, silicon dioxide, silicon carbide, silicon nitride, polysilicon glass, or other material. The conductive metal layers are generally formed, for example, of aluminum, gold or other metal or metal alloy. The film stacks 120, which are generally well known in the art, can be approximately 2.5 microns thick. The film stacks 120 can be, although need not be, positioned so that the resistor 118 is located over the respective support membrane 124. In this case, the resistors 118 will be located close to the ink feed hole 110 (to be formed). Alternatively, the resistors 118 need not be located over the respective support membranes 124 and are thus located farther away from the ink feed hole 110 (to be formed).

Figure 12:
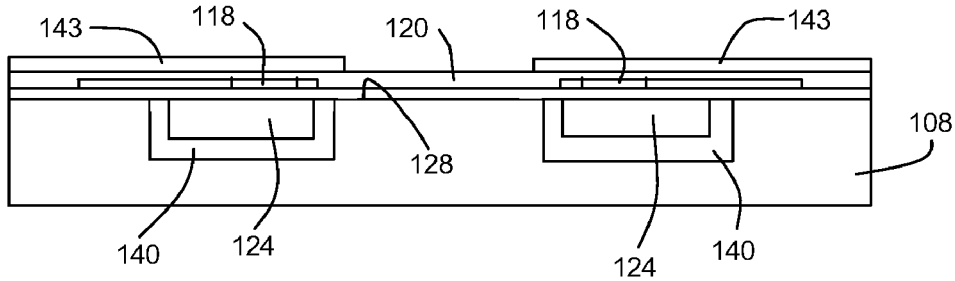
Figure 13:
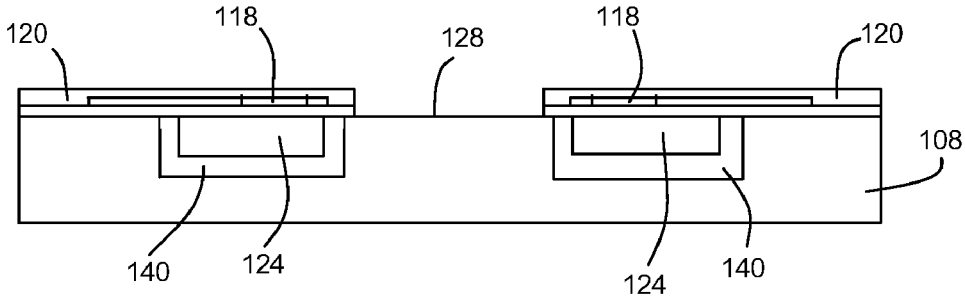

As shown in FIG. 12, the thin film stacks 120 are initially applied as a continuous stack covering the frontside surface 128. Then an ink feed hole mask 143 is formed superjacent the continuous film stack 120. The mask 143 delineates a region where the ink feed hole is to be formed in part. This region has zigzagged edges so as to provide a stagger pattern matching the pattern of the frontside photoresist mask 134, but with an offset so as to be somewhat smaller. The mask 143 is used to dry etch the continuous film stack 120 down to the frontside surface 128, as shown in FIG. 13. The mask 143 is then removed.

Figure 14:
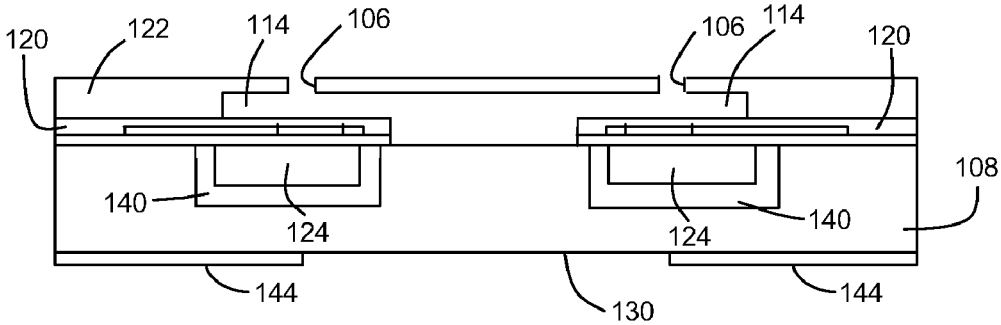

Referring to FIG. 14, the orifice layer 122 (which defines the firing chambers 114 and the nozzles 106) is applied superjacent the thin film stacks 120. The orifice layer 122 is preferably, although not necessarily, formed of a photoimagable epoxy such as SU8 available from several sources including MicroChem Corporation of Newton, Mass. In one approach, the orifice layer 122 is generated as three individual layers: a primer layer, a chamber layer and a nozzle layer. These layers are either spun on or laminated and then photoimaged. The firing chambers in the chamber layer are formed with the lost wax method prior to applying the nozzle layer. This approached is described in greater detail h commonly assigned U.S. Pat. No. 6,739,519 issued May 25, 2004 to Stout et al.

Next, the ink feed hole 110 is finished by etching the backside 130 of the substrate 108. The backside 130 is masked with a backside mask 144, such as a field oxide hard mask or photoresist, to define the desired shape or contour of the ink feed hole 110. The backside trench etching operation is preferably, but not necessarily, accomplished with a hybrid etch process. For example, one possible hybrid etch comprises an initial dry etch step in which approximately 80% of the silicon from the ink feed hole 110 is removed. Then, a wet etch (such as tetramethyl ammonium hydroxide (TMAH), ethylene diamine pyrocatecol (EDP), or potassium hydroxide (KOH) etches) is performed to remove the remaining silicon and define the final, zigzagged shape of the ink feed hole 110, as seen in FIGS. 2 and 3. Another possible hybrid etch would entail a laser etch followed by a wet etch. In either case, the trench layer oxide 140 encasing the support membranes 124 protects the membranes 124 from being attacked during the wet etch. The wet etch forms angled sidewalls 146 in the substrate 108 because of the rate at which the solution etches silicon. The result of the etching is an ink feed hole 110 (FIGS. 2 and 3) in which the sidewalls 148 defined by the trench layer oxide 140 and the edges 111 are zigzagged to match the stagger pattern.

While specific embodiments of the present invention have been described, it will be apparent to those skilled in the art that various modifications thereto can be made without departing from the spirit and scope of the invention as defined in the appended claims.

What is claimed is:

1. A thermal inkjet printhead comprising:

a substrate having an ink feed hole formed therethrough;

a thin film stack having a plurality of staggered resistors disposed on said substrate, wherein said thin film slack is undercut by said ink feed hole; and means for supporting said thin film stack undercut wherein said means for supporting includes a support membrane embedded in said substrate adjacent to said ink feed hole;

wherein said ink feed hole has sidewalls that are zigzagged so as to match the stagger of said resistors, and wherein said support membrane has an edge that is located adjacent to said ink feed hole and is zigzagged so as to match the stagger of said resistors.

2. The thermal inkjet printhead of claim 1 wherein said support membrane is made of polysilicon.

3. The thermal inkjet printhead of claim 1 wherein said resistors are positioned over said support membrane.

* * * * *

UNITED STATES PATENT AND TRADEMARK OFFICE

CERTIFICATE OF CORRECTION

PATENT NO. : 7,837,303 B2
APPLICATION NO. : 12/191076
DATED : November 23, 2010
INVENTOR(S) : Sadiq Bengali It is certified that error appears in the above-identified patent and that said Letters Patent is hereby corrected as shown below:

In column 7, line 13, in Claim 1, delete “slack” and insert -- stack --, therefor.

Signed and Sealed this
Fifteenth Day of March, 2011

David J. Kappos

David J. Kappos
*Director of the United States Patent and Trademark Office*